US007258552B2

(12) United States Patent
Wright et al.

(10) Patent No.: US 7,258,552 B2
(45) Date of Patent: Aug. 21, 2007

(54) SOCKET FOR HOLDING A CIRCUIT BOARD MODULE

(75) Inventors: Mitchel E. Wright, The Woodlands, TX (US); John R. Grady, Cypress, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1 day.

(21) Appl. No.: 11/174,759

(22) Filed: Jul. 5, 2005

(65) Prior Publication Data

US 2007/0010107 A1 Jan. 11, 2007

(51) Int. Cl.
*H01R 12/00* (2006.01)

(52) U.S. Cl. ..... 439/73

(58) Field of Classification Search ..... 439/59, 439/68, 70, 71, 72, 73

See application file for complete search history.

(56) References Cited

U.S. PATENT DOCUMENTS 4,560,217 A * 12/1985 Siano ..... 439/68
4,564,251 A * 1/1986 Hansen et al. ..... 439/71
4,742,385 A * 5/1988 Kohmoto ..... 257/697
5,156,649 A * 10/1992 Compton et al. ..... 439/68
5,292,266 A * 3/1994 Matsuoka ..... 439/526
5,346,402 A * 9/1994 Yasuho et al. ..... 439/71
5,364,278 A * 11/1994 Laub ..... 439/69
5,490,041 A * 2/1996 Furukawa et al. ..... 361/777
5,564,932 A * 10/1996 Castleman ..... 439/70
5,647,121 A * 7/1997 McLellan et al. ..... 29/840

OTHER PUBLICATIONS

Meritec—Surface Mount SOP Sockets on Tape & Reel, http://www.meritec.com/Pages/products/sockets/tapereel.html, 1997, p. 1.
Hexus.net : Review : MV Ixius 3.6 Laptop and NVIDIA GeForce 6800 Go 256MB, UK Technology News and Reviews, http://www.hexus.net/content/reviews/review_print.php?dXJsX3Jldmlld19JRD05MDU=, 2004, p. 1-4.
Enlarged photo of socket on p. 4 of Cite No. 2.

* cited by examiner

*Primary Examiner*—Tho D. Ta

(57) ABSTRACT

A socket is for use in an electronic system to hold a circuit board module that has spaced electrical pads proximate to two opposite edges thereof. The socket includes a base and electrical conductors. The base has rectangularly arranged peripheral portions and is for receiving the circuit board module. The electrical conductors align with the electrical pads on the circuit board module. At least portions of the electrical conductors are disposed on respectively opposite ones of the peripheral portions to contact at least portions of corresponding ones of the aligned electrical pads on the circuit board module when the circuit board module is held in the socket.

26 Claims, 6 Drawing Sheets

SOCKET FOR HOLDING A CIRCUIT BOARD MODULE

BACKGROUND

In electronic systems, some electronic components (e.g. integrated circuits, resistors, capacitors, diodes, etc.) are connected into the system through an electrical socket. A particular class of socket holds a circuit board module on which these components are mounted. The circuit board module provides electrical traces between the components and electrical pads at which electrical contact is made with electrical conductors on the socket. Electrical signals are exchanged off the circuit board module at the junction between the electrical pads of the circuit board modules and the electrical conductors of the socket. The socket provides electrical connections between the circuit board module and other portions of the electronic system, such as a motherboard, on which the socket is mounted. Sockets and circuit board modules of a given type are designed to work together with respect to physical dimensions and electrical signaling characteristics. The sockets and circuit board modules are also sometimes designed for allowable space within and physical characteristics of the electronic system in which the sockets and modules are to be used.

Current sockets allow for the electrical connection of circuit board modules with electrical pads along only one edge. This physical constraint on the structure of circuit board modules can sometimes be undesirable, particularly when there are a relatively large number of electrical pads on the edge of the circuit board module, thereby resulting in a fairly long edge. Such circuit board modules and their sockets are unusable in some electronic systems where spatial requirements are tightly restricted and performance requirements do not allow for a tradeoff to make the edge shorter and the circuit board module smaller.

DETAILED DESCRIPTION

Figure 1:
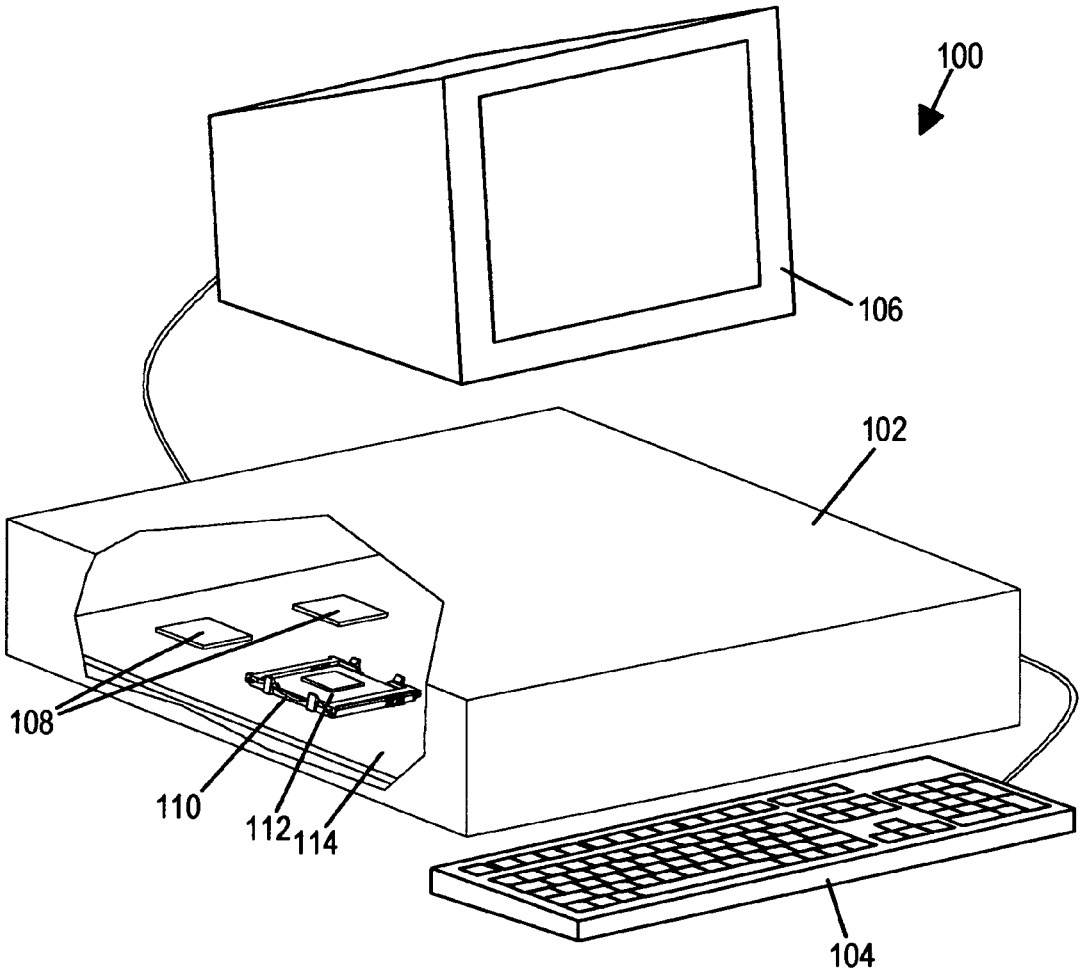
FIG. 1 is a top, front, left side perspective view of an electronic system incorporating an embodiment of the present invention.

A computer system 100 incorporating an embodiment of the present invention is shown in FIG. 1 having elements such as a housing 102, a keyboard 104 and a display 106. Among other components 108 within the housing 102, the computer system 100 includes an electrical socket 110, which holds a circuit board module 112. The electrical socket 110 is mounted at any appropriate location within the housing 102, such as to a printed circuit board 114. Although one embodiment is described with respect to its use in the computer system 100, exemplary embodiments in accordance with the present invention can be used in any appropriate electronic system or assembly that incorporates the circuit board module 112, regardless of any other elements or components included in the electronic system.

Additionally, according to an embodiment, the electrical socket 110 and the circuit board module 112 adhere to the standards for PCI Express bus signaling. Other embodiments may involve other signaling requirements. Furthermore, according to an embodiment, the circuit board module 112 is a small outline dual inline memory module (SODIMM). Other embodiments may involve other types of circuit board modules.

Figure 2:
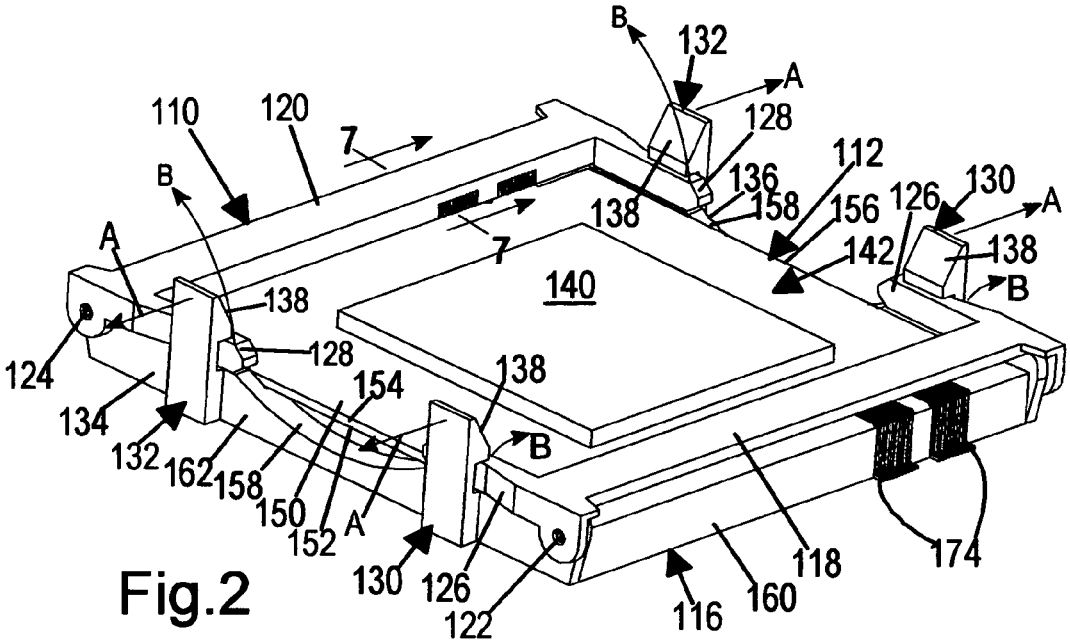
FIG. 2 is a top, front, left side perspective view of a socket with a circuit board module for use in the electronic system shown in FIG. 1 according to an embodiment of the present invention.
Figure 3:
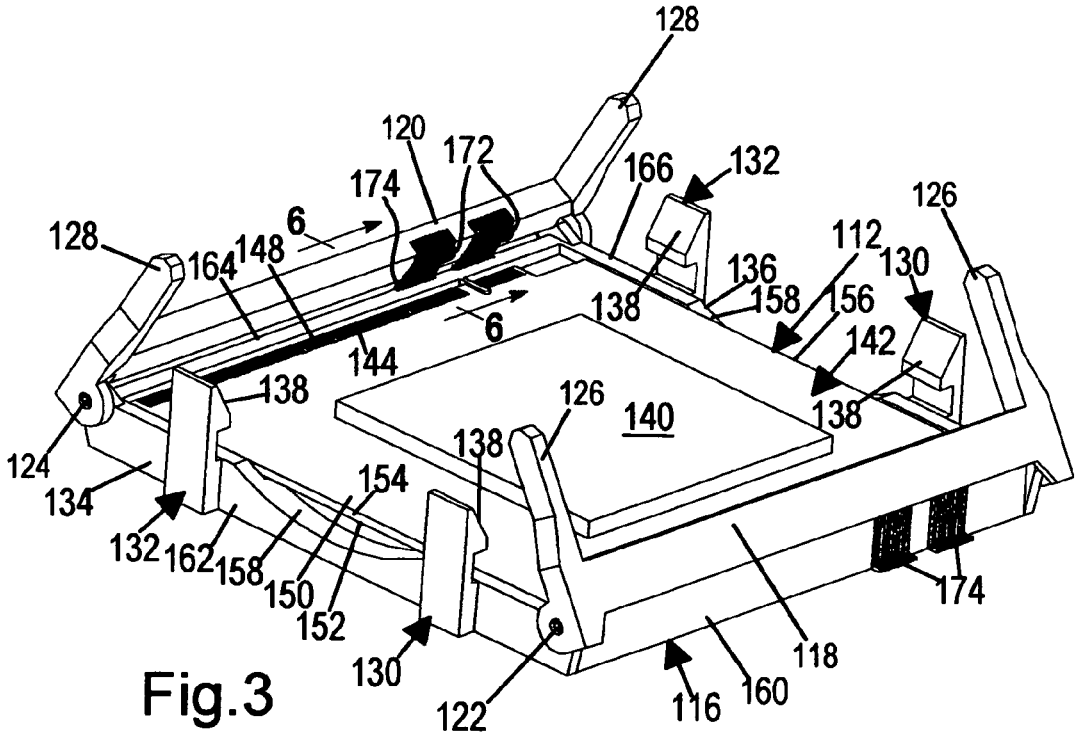
FIG. 3 is a top, front, left side perspective view of another configuration of the socket and circuit board module shown in FIG. 2.
Figure 4:
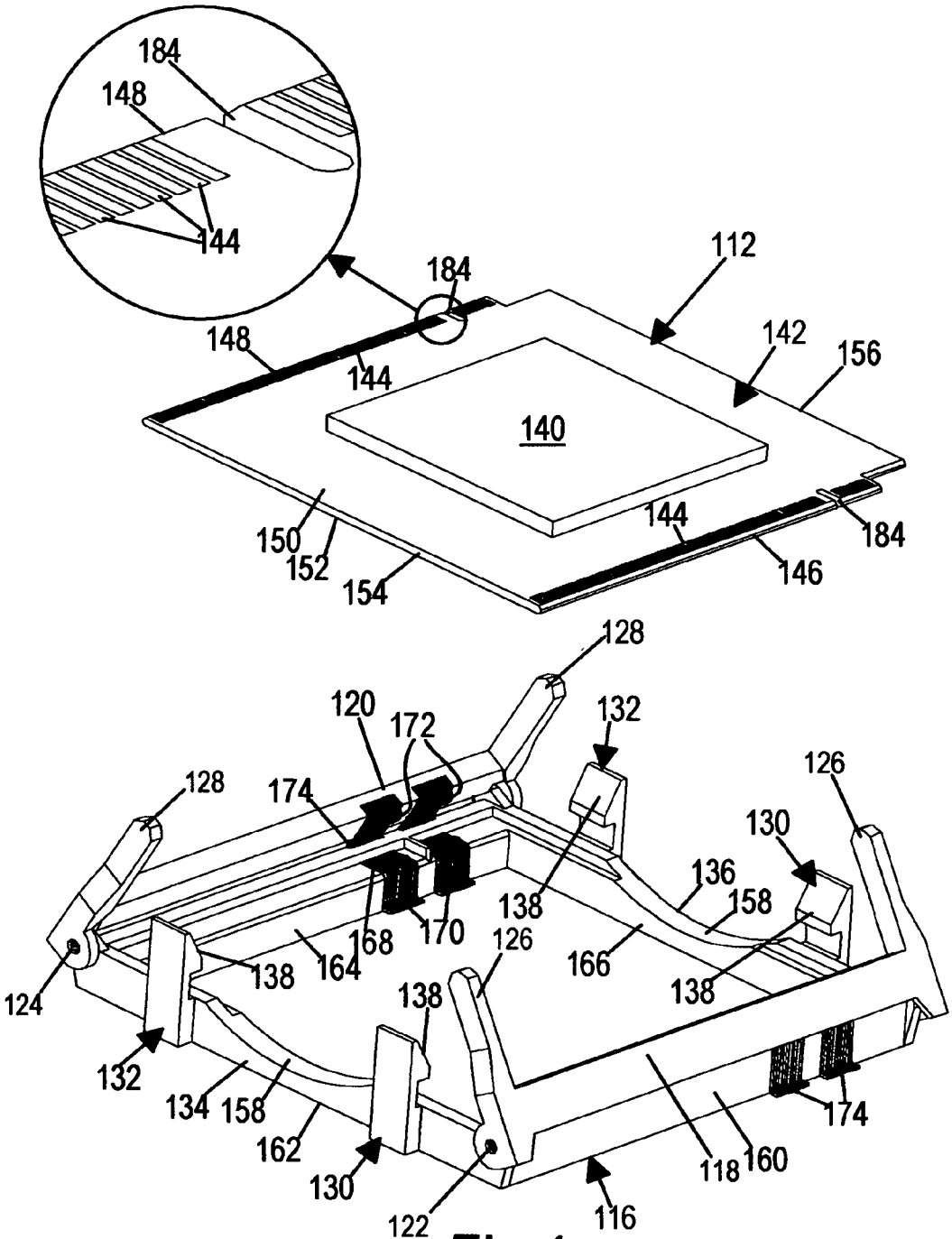
FIG. 4 is a top, front, left side perspective view of yet another configuration of the socket and circuit board module shown in FIG. 2.

The socket 110 includes a base 116, as shown in FIGS. 2, 3 and 4, which mounts to the printed circuit board 114 (FIG. 1) and receives the circuit board module 112. The socket 110 also includes clamping portions 118 and 120 pivotally attached to the base 116 at pivot points 122 and 124, respectively, on opposite sides of the base 116. Levers 126 and 128 extend from the clamping portions 118 and 120, respectively. Locking mechanisms 130 and 132 are disposed on opposite sides 134 and 136 of the base 116 adjacent the levers 126 and 128, respectively.

The clamping portions 118 and 120 and levers 126 and 128 pivot between an upward (open) position shown in FIGS. 3 and 4 and a downward (closed) position shown in FIG. 2. In the downward position, the locking mechanisms 130 and 132 engage the levers 126 and 128, respectively, to lock the clamping portions 118 and 120 in this position. The locking mechanisms 130 and 132 are capable of being deflected outwardly in the direction of arrows A in order to release the levers 126 and 128. When released, the levers 126 and 128 (and thus the clamping portions 118 and 120) can be pivoted upwards in the direction of arrows B. When pivoted back down, the levers 126 and 128 contact a sloped face 138 of the of locking mechanisms 130 and 132 to deflect the locking mechanisms 130 and 132 in the direction of arrows A until the levers 126 and 128 and the clamping portions 118 and 120 reach the downward position. At this point, the locking mechanisms 130 and 132 again engage the levers 126 and 128 to lock the clamping portions 118 and 120 in this position.

In an operational configuration, the circuit board module 112 is disposed within the socket 110 between the base 116 and the clamping portions 118 and 120. In this manner, the circuit board module 112 is firmly held within the socket 110 when the clamping portions 118 and 120 are in the downward position (FIG. 2). To remove the circuit board module 112 from the socket 110, the locking mechanisms 130 and 132 are flexed outwardly to release the levers 126 and 128 and the clamping portions 118 and 120 are pivoted to the upward position (FIG. 3). With the clamping portions 118 and 120 thus pivoted out of the way, the circuit board module 112 can be lifted away from the base 116, as shown in FIG. 4. To place the circuit board module 112 into the socket 110, this procedure is reversed.

The circuit board module 112 has one or more electronic components 140 mounted on a module board 142. The circuit board module 112 also has electrical contact pads 144 spaced along opposite edges 146 and 148 of the module board 142. According to some embodiments, the electrical contact pads 144 are also on both the top side 150 and the bottom side 152 of the module board 142.

When the circuit board module 112 is positoned on the base 116, portions of edges 154 and 156 of the module board 142 are exposed at reduced-height portion 158 of the sides 134 and 136 of the base 116, as shown in FIGS. 2 and 3. The exposed portions of the edges 154 and 156 may be gripped in order to remove the circuit board module 112 from the socket 110.

When the circuit board module 112 is placed in the socket 110, the edges 146 and 148 (FIG. 4) of the module board 142 are adjacent the clamping portions 118 and 120 of the socket 110 as shown in FIGS. 2 and 3. Therefore, when the clamping portions 118 and 120 are in the downward position, the circuit board module 112 is held in the socket 110 by the clamping portions 118 and 120 clamping down at or near the edges 146 and 148 of the module board 142.

The base 116 has rectangularly arranged peripheral portions 160, 162, 164 and 166 (FIG. 4). The interior of the base 116, according to some embodiments, is open to expose the printed circuit board 114 (FIG. 1), so the base 116 has an inner periphery as well as an outer periphery. Oppositely-facing peripheral portions 160 and 164 have electrical conductors 168 on the top side thereof. Electrical leads 170 extend from the electrical conductors 168 to the bottom of the peripheral portions 160 and 164 on the inner periphery side thereof. At this point, the electrical leads 170 are connected to matching electrical connection points on the printed circuit board 114. Additionally, the clamping portions 118 and 120 have electrical conductors 172 on the bottom side thereof. Additional electrical leads 174 extend from the electrical conductors 172 on the clamping portions 118 and 120 down the outer periphery side of the peripheral portions 160 and 164 to the bottom thereof. At this point, the electrical leads 174 are connected to additional matching electrical connection points on the printed circuit board 114.

To prevent obscuring some features of the base 116, only a few of the electrical conductors 168 and 172 and the electrical leads 170 and 174 are shown. In actuality, the electrical conductors 168 and 172 extend along the peripheral portions 160 and 164 and the clamping portions 118 and 120 to align with the electrical pads 144 on the bottom side 152 and the top side 150 of the module board 142.

Figure 5:
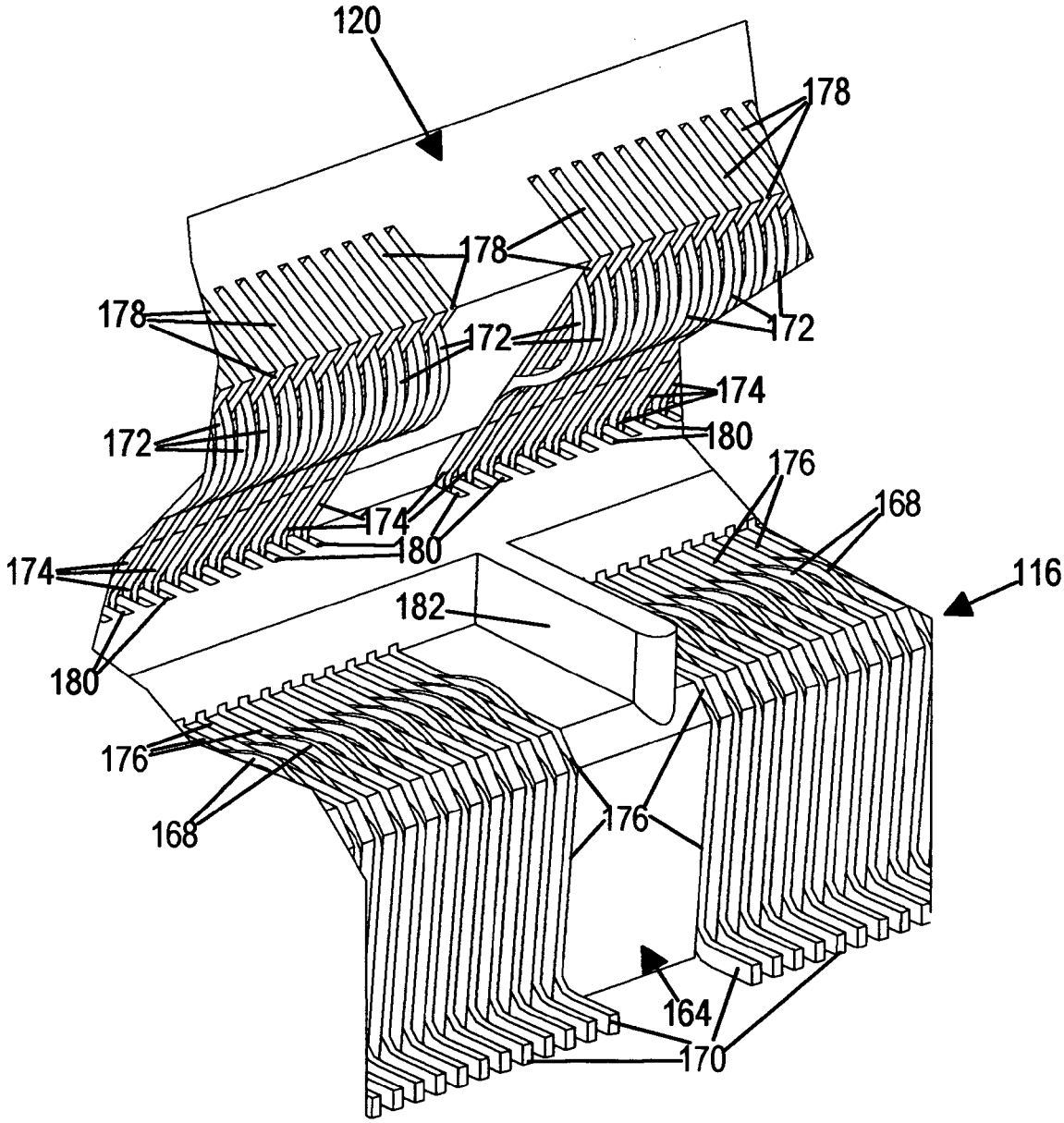
FIG. 5 is a top, front, left side perspective view of a cutaway portion of a socket for use in the electronic system shown in FIG. 1 according to an embodiment of the present invention.
Figure 6:
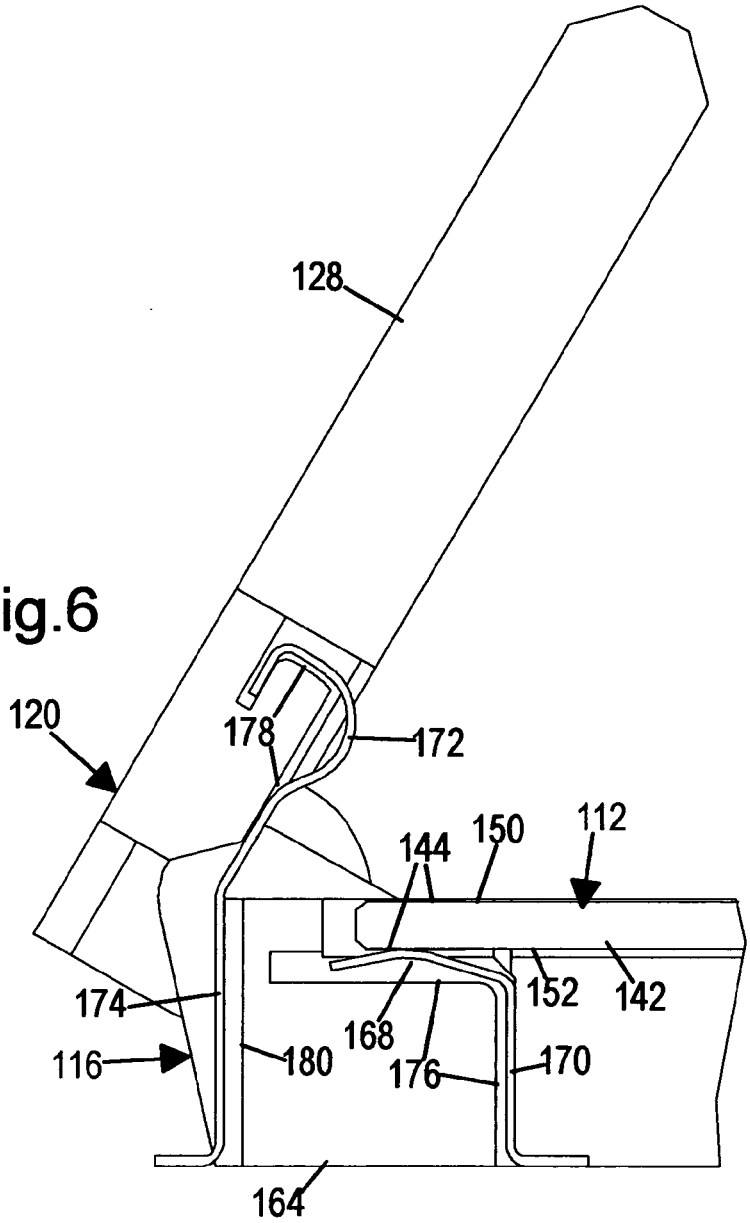
FIG. 6 is a side cross sectional view of a cutaway portion of a socket for use in the electronic system shown in FIG. 1 according to an embodiment of the present invention.
Figure 7:
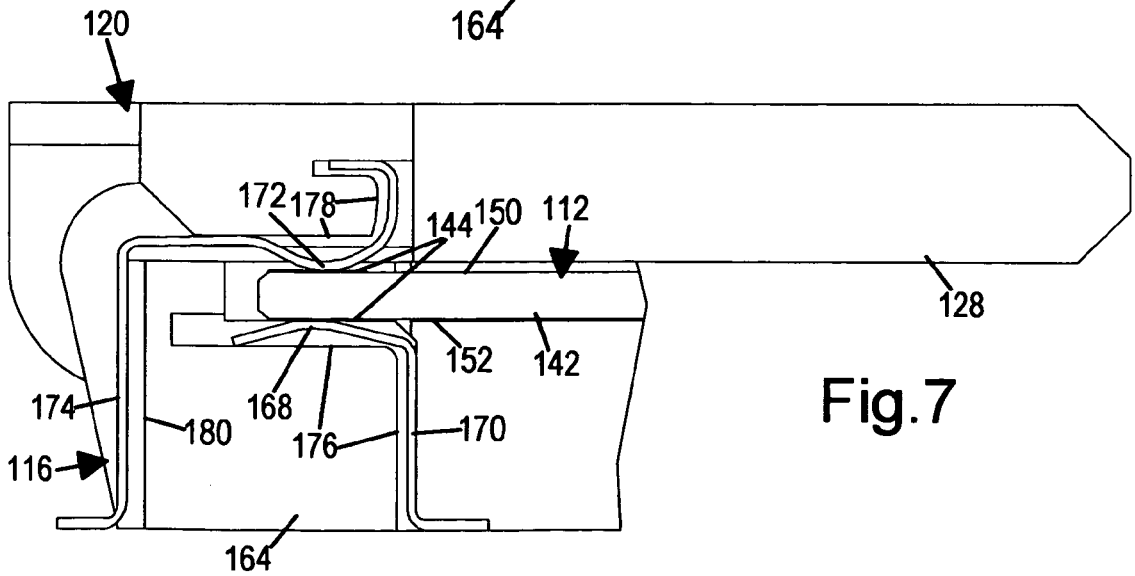
FIG. 7 is a side cross sectional view of another cutaway portion of a socket for use in the electronic system shown in FIG. 1 according to an embodiment of the present invention.

The electrical conductors 168 and the electrical leads 170 fit within grooves 176 in the peripheral portion 164 (and 160), as shown in FIGS. 5, 6 and 7. Similarly, the electrical conductors 172 and the electrical leads 174 fit within grooves 178 and 180 in the clamping portion 120 (and 118) and the peripheral portion 164 (and 160), respectively. According to a particular embodiment, each electrical connector 168 and 172 is formed along with a corresponding electrical lead 170 and 174 from a single piece of conductive material (e.g. metal, etc). Additionally, the conductive material is shaped to conform to the grooves 176, 178 and 180. The base 116 and the clamping portion 120 (and 118) are made of a nonconducting material (e.g. plastic, etc), so the walls of the grooves 176, 178 and 180 insulate the electrical conductors/leads 168/170 and 172/174 from each other.

The electrical conductors 168 protrude in a curved spring-like manner above the top surface of the peripheral portion 164 (and 160) when the clamping portion 120 is in the open position, as shown in FIGS. 5 and 6. Similarly, the electrical conductors 172 protrude in a curved spring-like manner below the bottom surface of the clamping portion 120 (and 118). Thus, when the clamping portion 120 (and 118) clamps down on the module board 142 of the circuit board module 112, the electrical conductors 168 and 172 deflect into the grooves 176 and 178, respectively, as shown in FIG. 7, wherein the clamping portion 120 is in the closed position. In this manner, the electrical conductors 168 and 172 maintain a spring force on the module board 142, which holds the circuit board module 112 in place.

When the circuit board module 112 is in the socket 110 and the clamping portion 120 (and 118) is in the downward position, the electrical conductors 168 on the top side of the peripheral portion 164 (and 160) make electrical connections with the electrical pads 144 on the bottom side 152 of the module board 142. Additionally, the electrical conductors 172 on the bottom side of the clamping portion 120 (and 118) make electrical connections with the electrical pads 144 on the top side 150 of the module board 142. In this manner, electrical connections are established between the circuit board module 112 and the printed circuit board 114 (FIG. 1). The electrical connections are maintained by the spring force between the electrical conductors 168 and 172 and the module board 142.

Proper alignment of the electrical conductors 168 and 172 with the matching electrical pads 144 is ensured by the physical tolerance between the peripheral portions 162 and 166 (FIG. 4) and the module board 142. A guide protrusion 182 (FIG. 5) extending from each of the peripheral portions 160 (not shown) and 164, which matches a guide notch 184 (FIG. 4) in each of the opposite edges 146 and 148 of the module board 142, also enables proper placement and alignment of the circuit board module 112 in the socket 110.

Figure 8:
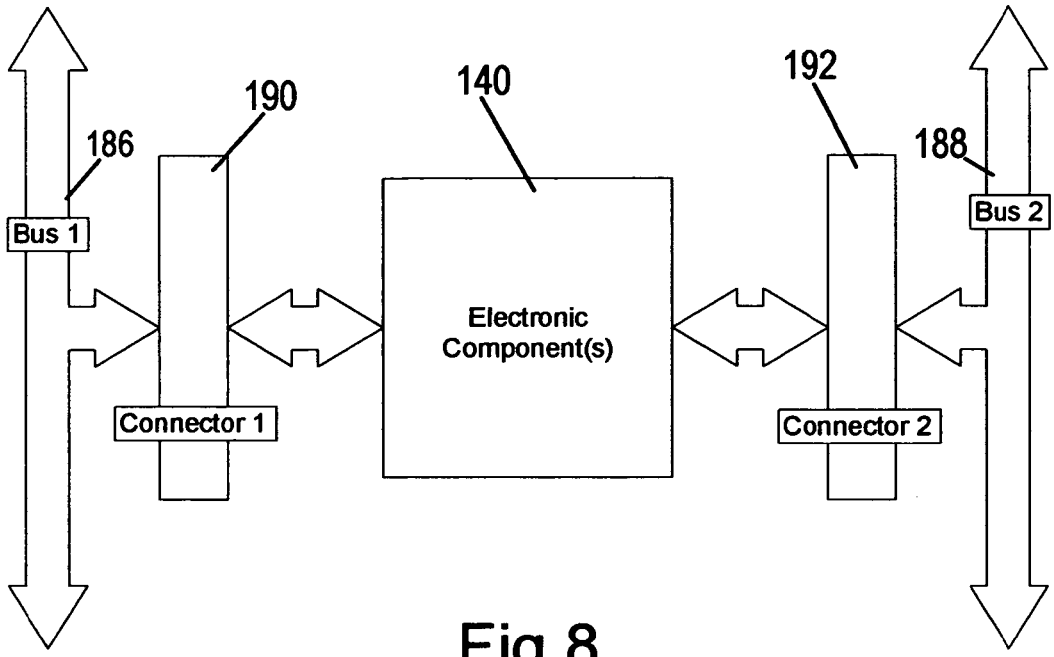
FIG. 8 is a simplified schematic diagram of a portion of the computer system shown in FIG. 1 including a socket and a circuit board module according to an embodiment of the present invention.

According to an embodiment, when the circuit board module 112 is held in the socket 110, the electronic components 140 are connected to two different bus systems 186 and 188 (e.g. PCI Express standard bus systems, etc) through first and second connectors 190 and 192, respectively, as shown in FIG. 8. In this case, the first connector 190 represents the connection between the electrical pads 144 at one edge 146 of the module board 142 and the matching electrical conductors 168 and 172 on the peripheral portion 160 and the clamping portion 118. Similarly, the second connector 192 represents the connection between the electrical pads 144 at the other edge 148 of the module board 142 and the matching electrical conductors 168 and 172 on the opposite peripheral portion 164 and the clamping portion 120. According to this embodiment, therefore, approximately twice the bus transfer bandwidth can be achieved with the socket 110 than can be achieved with a socket that connects to a circuit board module that has electrical pads on only one edge. In fact, one of the bus systems 186 can be used for transfers coming into the circuit board module 112, while the other bus system 188 is used for outgoing transfers. In this manner, the need to change the direction of bus transfers is eliminated, which would otherwise slow down the bus transfers.

Figure 9:
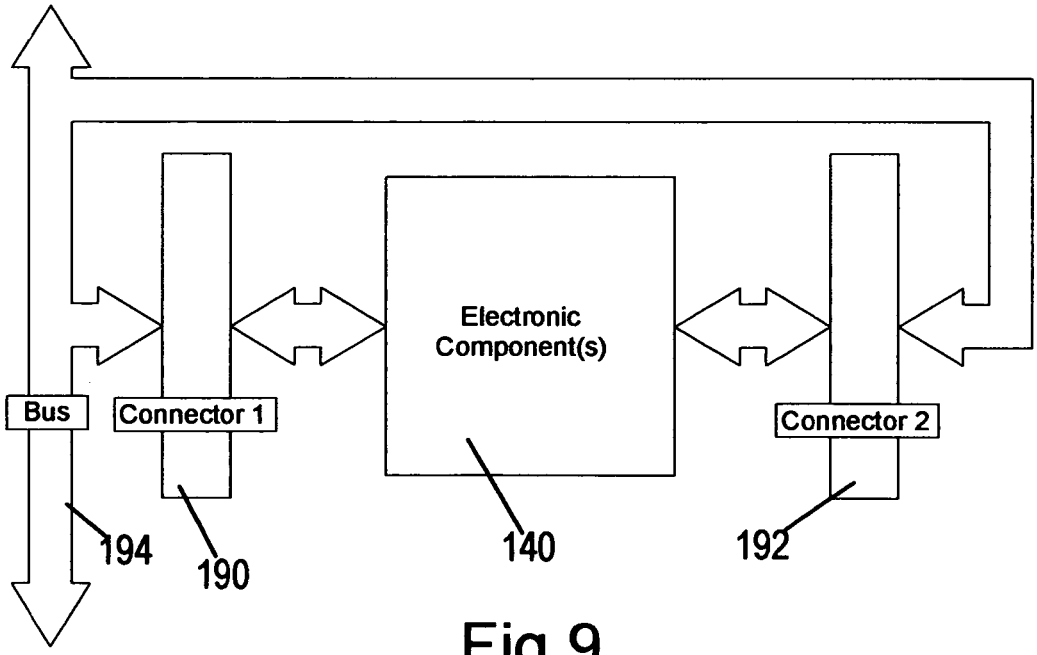
FIG. 9 is another simplified schematic diagram of a portion of the computer system shown in FIG. 1 including a socket and a circuit board module according to an embodiment of the present invention.

According to another embodiment, when the circuit board module 112 is held in the socket 110, the electronic components 140 are connected to only one bus system 194 through the first and second connectors 190 and 192, as shown in FIG. 9. According to this embodiment, therefore, the same bus transfer bandwidth is achieved with the socket 110 as is achieved with a socket that connects to a circuit board module that has electrical pads on only one edge. However, since the electrical pads 144 are divided between two edges 146 and 148 of the module board 142, the module board 142 (and thus the circuit board module 112) can be made with an overall smaller area than can a module board having electrical pads on only one edge, depending on the size and number of the electronic components 140.

We claim:

1. A socket for use in an electronic system to hold a circuit board module that has spaced electrical pads proximate to two opposite edges thereof, comprising:

a base having rectangularly arranged peripheral portions, for mounting within the electronic system and for receiving the circuit board module;

first electrical conductors disposed on the base aligned with the electrical pads on the circuit board module, the electrical conductors including at least portions disposed on respectively opposite ones of the peripheral portions to contact at least portions of corresponding ones of the aligned electrical pads on the circuit board module when the circuit board module is held in the socket;

two clamping portions mounted on the base respectively adjacent the two opposite ones of the peripheral portions to clamp the circuit board module onto the base; and second electrical conductors disposed on the clamping portions to contact respective portions of the electrical pads on the circuit board module when the clamping portions clamp the circuit board module onto the base.

2. A socket as defined in claim 1 further comprising:

at least two lever mechanisms connected to the respective clamping portions to pivot the clamping portions between a closed position and an open position; and at least two locking mechanisms for locking the respective clamping portions in the closed position;

and wherein:

the socket can hold the circuit board module between the base portion and the clamping portions when the circuit board module is disposed within the socket and the clamping portions are locked in the closed position; and the second electrical conductors the respective portions of the electrical pads on the circuit board module when the circuit board module is disposed within the socket and the clamping portions are pivoted to the closed position.

3. A socket as defined in claim 1 wherein:

the base has an inner periphery and an outer periphery for the peripheral portions; and the two opposite ones of the peripheral portions each has electrical leads disposed on the inner periphery and the outer periphery.

4. A socket as defined in claim 3 wherein:

the electrical leads disposed on the inner peripheries of the two opposite ones of the peripheral portions of the base extend between the first electrical conductors disposed on the two opposite ones of the peripheral portions and a floor of the base.

5. A socket as defined in claim 3 wherein:

the electrical leads disposed on the outer periphery of the two opposite ones of the peripheral portions of the base extend between the respective electrical conductors disposed on the clamping portions and a floor of the base.

6. A socket as defined in claim 1 wherein:

the electrical conductors disposed on a first one of the two opposite peripheral portions form at least part of a first bus connector for the circuit board module when the circuit board module is held in the socket; and the electrical conductors disposed on a second one of the two opposite peripheral portions form at least part of a second bus connector for the circuit board module when the circuit board module is held in the socket.

7. A socket as defined in claim 6 wherein:

the first bus connector is for connecting to a first bus system; and the second bus connector is for connecting to a second bus system.

8. A socket as defined in claim 6 wherein:

the first and second bus connectors are for connecting to a common bus system.

9. A socket for use in an electronic system to hold a circuit board module that has spaced electrical pads proximate to first and second opposite edges thereof, comprising:

means for receiving the circuit board module;

means for electrically contacting the electrical pads of the circuit board module when the circuit board module is held in the socket, first portions of the electrically contacting means arranged on the receiving means to align with and contact at least portions of the electrical pads proximate to the first opposite edge of the circuit board module, second portions of the electrically contacting means arranged on the receiving means to align with and contact at least portions of the electrical pads proximate to the second opposite edge of the circuit board module; and first and second means for clamping onto the circuit board module to hold the circuit board module to the receiving means, the first clamping means clamping onto the circuit board module proximate to the first opposite edge, the second clamping means clamping onto the circuit board module proximate to the second opposite edge, third portions of the electrically contacting means arranged on the first clamping means to align with and contact at least portions of the electrical pads proximate to the first opposite edge of the circuit board module, and fourth portions of the electrically contacting means arranged on the second clamping means to align with and contact at least portions of the electrical pads proximate to the second opposite edge of the circuit board module.

10. A printed circuit board for use in an electronic system, comprising:

a board;

a socket having a base, two clamping portions and first and second electrical conductors, the base mounted on the board and having rectangularly arranged peripheral portions, at least portions of the first electrical conductors disposed on respectively opposite ones of the peripheral portions, the two clamping portions mounted on the base respectively adjacent the two opposite ones of the peripheral portions to clamp the circuit board module onto the base, and the second electrical conductors disposed on the clamping portions; and a circuit board module held in the socket and having spaced electrical pads proximate to two opposite edges thereof;

and wherein:

the base of the socket receives the circuit board module;

the first electrical conductors of the socket contact at least portions of the electrical pads on the circuit board module; and the second electrical conductors contact respective portions of the electrical pads on the circuit board module.

11. A printed circuit board as defined in claim 10 wherein the socket further comprises:

at least two lever mechanisms connected to the respective clamping portions to pivot the clamping portions between a closed position and an open position; and at least two locking mechanisms for locking the respective clamping portions in the closed position;

and wherein:

the socket holds the circuit board module between the base portion and the clamping portions when the clamping portions are locked in the closed position; and the second electrical conductors contact the respective portions of the electrical pads on the circuit board module when the clamping portions are pivoted to the closed position.

12. A printed circuit board as defined in claim 10 wherein:

the base of the socket has an inner periphery and an outer periphery for the peripheral portions; and the two opposite ones of the peripheral portions each has electrical leads disposed on the inner periphery and the outer periphery.

13. A printed circuit board as defined in claim 12 wherein:

the electrical leads disposed on the inner peripheries of the two opposite ones of the peripheral portions of the base extend between the first electrical conductors disposed on the two opposite ones of the peripheral portions and a floor of the base and electrically connect to the board.

14. A printed circuit board as defined in claim 12 wherein:

the electrical leads disposed on the outer periphery of the two opposite ones of the peripheral portions of the base extend between the respective electrical conductors disposed on the clamping portions and a floor of the base and electrically connect to the board.

15. A printed circuit board as defined in claim 10 wherein:

the electrical conductors disposed on a first one of the two opposite peripheral portions of the base of the socket form at least part of a first bus connector to the circuit board module; and the electrical conductors disposed on a second one of the two opposite peripheral portions form at least part of a second bus connector to the circuit board module.

16. A printed circuit board as defined in claim 15 wherein:

the first bus connector connects the circuit board module to a first bus system on the board; and the second bus connector connects the circuit board module to a second bus system on the board.

17. A printed circuit board as defined in claim 15 wherein:

the first and second bus connectors connect the circuit board module to a common bus system on the board.

18. A computer system comprising:

a housing containing computer components; and a printed circuit board mounted within the housing and comprising:

a board mounted to the housing;

a socket having a base, two clamping portions and first and second electrical conductors; and a circuit board module held in the socket and having spaced electrical pads proximate to two opposite edges thereof;

and wherein:

the base is mounted on the board and has rectangularly arranged peripheral portions;

at least portions of the first electrical conductors are disposed on respectively opposite ones of the peripheral portions;

the base of the socket receives the circuit board module;

the first electrical conductors of the socket contact at least portions of the electrical pads on the circuit board module;

the two clamping portions are mounted on the base respectively adjacent the two opposite ones of the peripheral portions to clamp the circuit board module onto the base; and the second electrical conductors are disposed on the clamping portions and contact respective portions of the electrical pads on the circuit board module.

19. A computer system as defined in claim 18 wherein the socket further comprises:

at least two lever mechanisms connected to the respective clamping portions to pivot the clamping portions between a closed position and an open position; and at least two locking mechanisms for locking the respective clamping portions in the closed position;

and wherein:

the socket holds the circuit board module between the base portion and the clamping portions when the clamping portions are locked in the closed position; and the second electrical conductors contact the respective portions of the aligned electrical pads on the circuit board module when the clamping portions are pivoted to the closed position.

20. A computer system as defined in claim 18 wherein:

the base of the socket has an inner periphery and an outer periphery for the peripheral portions; and the two opposite ones of the peripheral portions each has electrical leads disposed on the inner periphery and the outer periphery.

21. A computer system as defined in claim 20 wherein:

the electrical leads disposed on the inner peripheries of the two opposite ones of the peripheral portions of the base extend between the electrical conductors disposed on the two opposite ones of the peripheral portions and a floor of the base and electrically connect to the board.

22. A computer system as defined in claim 20 wherein:

the electrical leads disposed on the outer periphery of the two opposite ones of the peripheral portions of the base extend between the respective electrical conductors disposed on the clamping portions and a floor of the base and electrically connect to the board.

23. A computer system as defined in claim 18 wherein:

the electrical conductors disposed on a first one of the two opposite peripheral portions of the base of the socket form at least part of a first bus connector to the circuit board module; and the electrical conductors disposed on a second one of the two opposite peripheral portions form at least part of a second bus connector to the circuit board module.

24. A computer system as defined in claim 23 wherein:

the first bus connector connects the circuit beard module to a first bus system on the board; and the second bus connector connects the circuit board module to a second bus system on the board.

25. A computer system as defined in claim 23 wherein:

the first and second bus connectors connect the circuit board module to a common bus system on the board.

26. A method of connecting a circuit board module to a printed circuit board, comprising:

providing a socket mounted on the printed circuit board, the socket comprising a base, first and second clamping portions and electrical conductors, the base mounted on the printed circuit board, at least first portions of the electrical conductors disposed on a first side of the base, at least second portions of the electrical conductors disposed on a second side of the base opposite the first side, the first and second clamping portions mounted on the base proximate to the first and second sides, respectively, of the base, at least third portions of the electrical conductors of the socket disposed on the first clamping portion, at least fourth portions of the electrical conductors disposed on the second clamping portion;

placing the circuit board module on the base, the circuit board module having spaced electrical pads proximate to first and second opposite edges thereof, the circuit board module placed on the base with at least portions of the electrical pads proximate to the first edge of the circuit board module contacting the electrical conductors disposed on the first side of the base and at least portions of the electrical pads proximate to the second edge of the circuit board module contacting the electrical conductors disposed on the second side of the base; and clamping the first and second clamping portions onto the circuit board module with the third portion of the electrical conductors contacting a portion of the electrical pads proximate to the first edge of the circuit board module and the fourth portion of the electrical conductors contacting a portion of the electrical pads proximate to the second edge of the circuit board module.

* * * * *

UNITED STATES PATENT AND TRADEMARK OFFICE

CERTIFICATE OF CORRECTION

PATENT NO. : 7,258,552 B2
APPLICATION NO. : 11/174759
DATED : August 21, 2007
INVENTOR(S) : Mitchel E. Wright et al.

It is certified that error appears in the above-identified patent and that said Letters Patent is hereby corrected as shown below:

In column 5, line 45, in Claim 2, after “conductors” insert -- contact --.

In column 8, line 59, in Claim 24, delete “beard” and insert -- board --, therefor.

Signed and Sealed this

Twenty-second Day of July, 2008

JON W. DUDAS
*Director of the United States Patent and Trademark Office*